US007739836B2

(12) United States Patent
Keane et al.

(10) Patent No.: US 7,739,836 B2
(45) Date of Patent: Jun. 22, 2010

(54) VEHICLE DOOR WITH SELECTIVE FULL OPEN POSITIONS

(75) Inventors: John V Keane, Auburn Hills, MI (US); Ronald Frank, Clarkston, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 1065 days.

(21) Appl. No.: 11/146,796

(22) Filed: Jun. 7, 2005

(65) Prior Publication Data

US 2006/0272216 A1 Dec. 7, 2006

(51) Int. Cl.
*E05C 17/22* (2006.01)

(52) U.S. Cl. ..... 49/339; 49/381; 16/86 C

(58) Field of Classification Search ..... 49/502, 49/381, 339; 16/86 C, 86 B; 296/146.11
See application file for complete search history.

(56) References Cited

U.S. PATENT DOCUMENTS

| | | | | |
|---|---|---|---|---|
| 5,428,925 | A * | 7/1995 | Snyder | 49/367 |
| 5,483,771 | A * | 1/1996 | Herbst | 49/504 |
| 5,540,466 | A * | 7/1996 | Duynstee | 292/263 |
| 5,687,507 | A * | 11/1997 | Beran | 49/340 |
| 6,370,733 | B2 * | 4/2002 | Paton et al. | 16/86 C |
| 6,438,794 | B2 * | 8/2002 | Ng et al. | 16/82 |
| 6,711,778 | B2 * | 3/2004 | Sparkman | 16/86 C |
| 6,728,993 | B1 * | 5/2004 | Murayama | 16/342 |
| 7,076,833 | B2 * | 7/2006 | Murayama et al. | 16/82 |
| 7,257,860 | B2 * | 8/2007 | Jankovich et al. | 16/82 |
| 7,356,968 | B2 * | 4/2008 | Joyce et al. | 52/19 |
| 7,373,693 | B2 * | 5/2008 | Markl et al. | 16/374 |
| 7,383,614 | B2 * | 6/2008 | Matsuki | 16/86 B |
| 2003/0159244 | A1 * | 8/2003 | Sparkman | 16/86 C |
| 2003/0163895 | A1 * | 9/2003 | Liang et al. | 16/82 |
| 2004/0075285 | A1 * | 4/2004 | Murayama et al. | 292/265 |
| 2005/0022453 | A1 * | 2/2005 | Bosio | 49/343 |
| 2005/0134084 | A1 * | 6/2005 | Rangnekar et al. | 296/146.11 |
| 2007/0245517 | A1 * | 10/2007 | Kiefer et al. | 16/52 |

FOREIGN PATENT DOCUMENTS

| | | | |
|---|---|---|---|
| EP | 216689 | A1 * | 4/1987 |
| EP | 422374 | A1 * | 4/1991 |

* cited by examiner

*Primary Examiner*—Katherine W Mitchell
*Assistant Examiner*—Michael J Keller
(74) *Attorney, Agent, or Firm*—Ralph E. Smith

(57) ABSTRACT

An apparatus is provided for establishing at least two open access door positions relative to an opening of a compartment. The apparatus includes a position defining member having at least one engagement element, and a stop member. The position defining member is adapted to be coupled to the compartment. A housing member is adapted to be coupled to the access door for movement therewith, and has an opening for translatable receipt of the position defining member. The housing member further includes an engagement element operable to engage the at least one engagement element of the position defining member to establish a first open access door position. The stop member contacting the housing member establishes a second open access door position approximately perpendicular to the compartment.

11 Claims, 6 Drawing Sheets

VEHICLE DOOR WITH SELECTIVE FULL OPEN POSITIONS

FIELD OF THE INVENTION

The present invention relates to motor vehicles, and more particularly to a vehicle door with selective full open positions.

BACKGROUND OF THE INVENTION

Currently, most motor vehicles employ mechanisms which enable access into the interior of the passenger compartment of the vehicle through at least one door. The current door systems, however, only enable the occupant to open the door to approximately seventy degrees, which tends to restrict the ingress and egress of the occupants into the vehicle. In addition, by restricting the opening to approximately seventy degrees, the ability of the occupant to load cumbersome items into the vehicle is also reduced.

Accordingly, it is desirable to provide a motor vehicle which has a door opening mechanism which allows the door to open beyond seventy degrees to facilitate easier ingress and egress to the motor vehicle.

SUMMARY OF THE INVENTION

The present invention provides an apparatus for establishing at least two open access door positions relative to an opening of a compartment.

The apparatus includes a position defining member having at least one engagement element, and a stop member. The position defining member is adapted to be coupled to the compartment. A housing member is adapted to be coupled to the access door for movement therewith, and has an opening therethrough for translatable receipt of the position defining member. The housing member further includes an engagement element operable to engage the at least one engagement element of the position defining member to establish a first open access door position. The stop member contacting the housing member establishes a second open access door position approximately perpendicular to the compartment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The present invention is generally related to a vehicle door with selective full open positions. Although the following exemplary description refers to the use of the vehicle door with selective full open positions with a motor vehicle, it will be understood that the present invention may be applicable to other types of vehicles and other applications in general. Further, the foregoing description is understood to not limit the appended claims.

Figure 1:
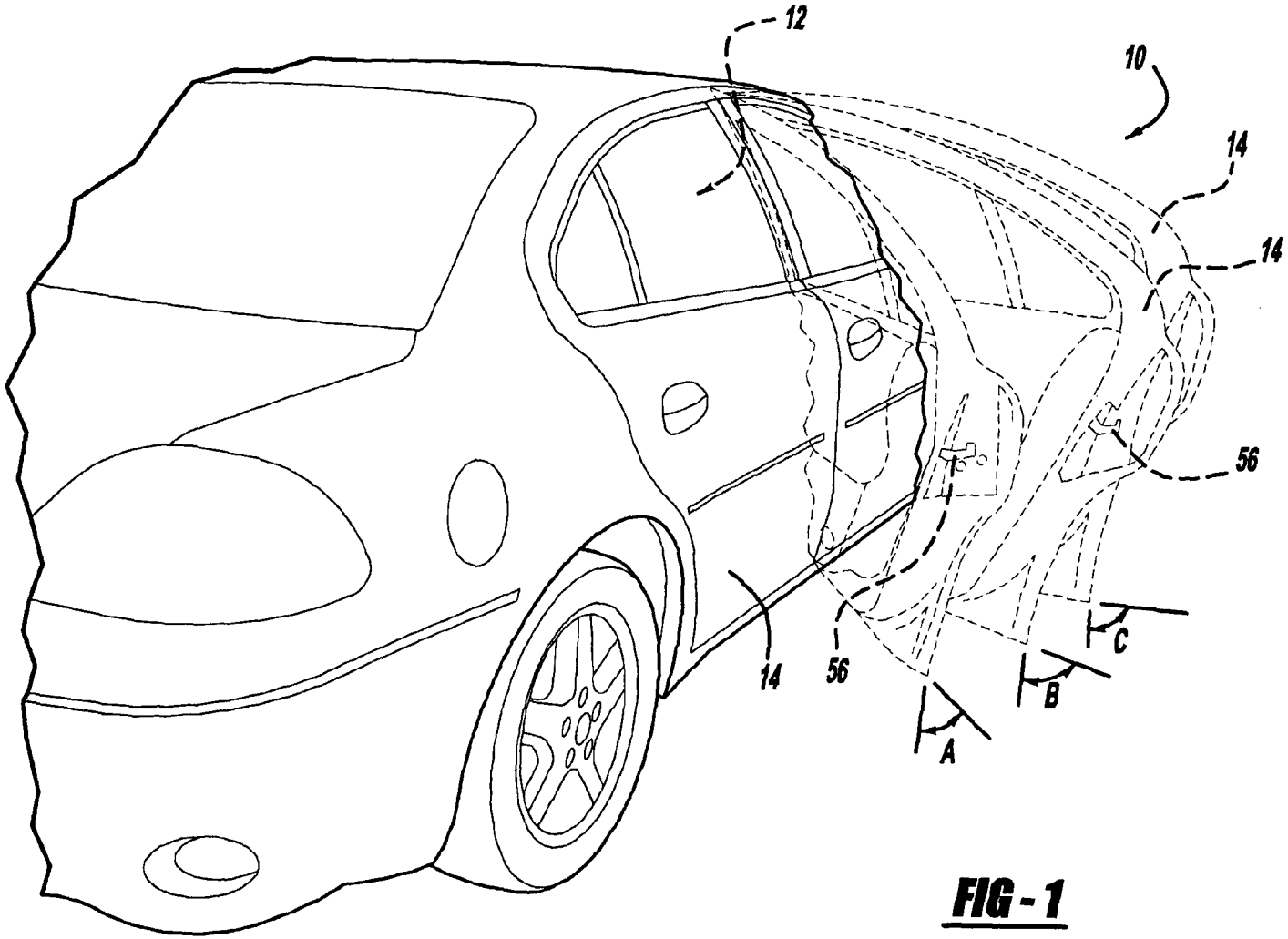
FIG. 1 is a perspective view of a vehicle incorporating the vehicle door with selective full open positions according to the principles of the present invention.
Figure 2A:
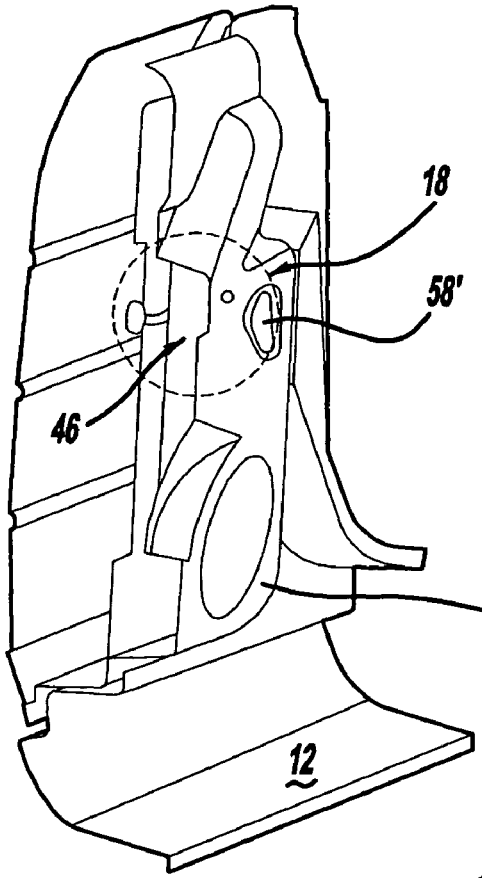
FIG. 2*a* is a detailed perspective view of the vehicle door of FIG. 1 in a closed position.
Figure 2B:
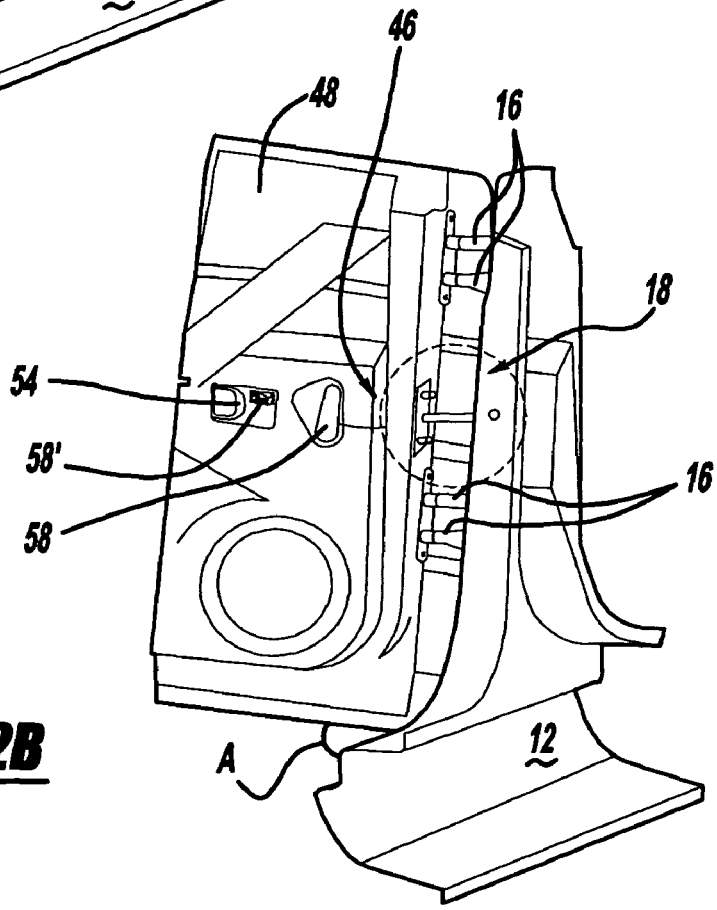
FIG. 2*b* is a detailed perspective view of the vehicle door of FIG. 1 in a first full open position.

With reference to FIGS. 1, 2A and 2B, a motor vehicle 10 is shown. The motor vehicle 10 includes a passenger compartment 12. The passenger compartment 12 is accessible via at least one door 14. The door 14 is coupled to the passenger compartment 12 via at least one hinge or multiple hinges 16 and a door release system 18. The hinges 16 and door release system 18 enable the door 14 to operate in a first position, a second position and a third position with respect to the passenger compartment 12 (as best shown in FIGS. 2A, 2B, 2C and 2D).

With continuing reference to FIG. 1, and additional reference to FIGS. 2*a*, 2*b*, 2*c*, 2*d*, and 3, the door 14 is coupled to the passenger compartment 12 by hinges 16. The hinges 16 are generally formed of a metallic material, such as steel, however, any appropriate material could be used. The hinges 16 include a base portion 20 coupled to a door portion 22. The base portion 20 includes a generally U-shaped section 24 coupled to a base 26. The base 26 includes at least two apertures 32 operable to couple the base portion 20 to the passenger compartment 12. The U-shaped section 24 is typically formed integrally with the base 26, and a branch 28 on the U-shaped section 24 may include at least one lanced depression 30 operable to engage the door portion 22 when the door 14 is in the third position, as will be described in greater detail below. Each branch 28 further includes at least one aperture 32 operable to couple the base portion 20 to the door portion 22.

The door portion 22 of each of the hinges 16 includes a generally U-shaped section 34. The U-shaped section 34 includes at least two apertures 36, each operable to receive at least one fastener 38 to couple the door portion 22 to the base portion 20 to create a pivot axis P. The pivot axis P enables the door 14 to pivot with respect to the passenger compartment 12. The U-shaped section 34 has two branches 40 which each define an aperture 44. The apertures 44 are operable to couple the door 14 to the base portion 20, and thus, the hinges 16 enable the door 14 to pivot with respect to the passenger compartment 12. Although both the base portion 20 and door portion 22 of the hinges 16 are described as including U-shaped sections 24, 34, it will be understood that any appropriate shape could be used to achieve the same function as the U-shaped sections 24, 34. The pivoting of the door 14 on the hinges 16 is controlled via the door release system 18.

The door release system 18 includes an opening system 46 mounted on an interior surface 48 of the door 14 as best shown in FIGS. 2A, 2B, 2C and 2D. The opening system 46 is coupled to a door check strap 50. The door check strap 50 is further coupled to a housing 52. The door check strap 50 and housing 52 cooperate to enable the door 14 to open into the first, second and third full open positions.

The opening system 46 includes a first lever 54, a door latch 56 and a switch 58. The first lever 54 is coupled to the interior surface 48 of the door 14 and may be any type of mechanism which is capable of releasing the door 14 into the first and second full open positions, such as, a formed U-shaped lever, handle or other pivoting device. The first lever 54 is also coupled to the door latch 56 via a linkage (not shown). The linkage may be configured such that when the first lever 54 is pivoted the linkage will release the door latch 56.

Figure 2C:
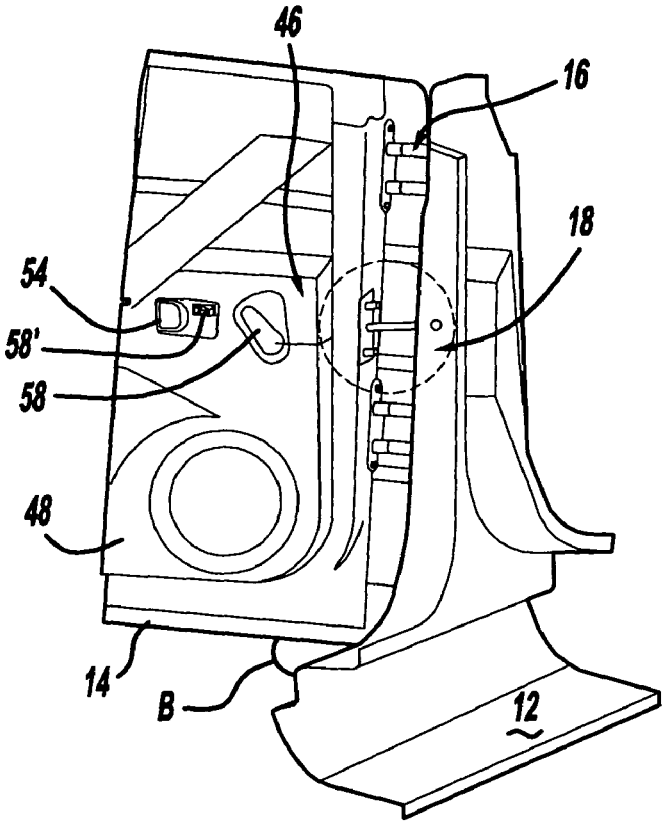
FIG. 2*c* is a detailed perspective view of the vehicle door of FIG. 1 in a second full open position.
Figure 2D:
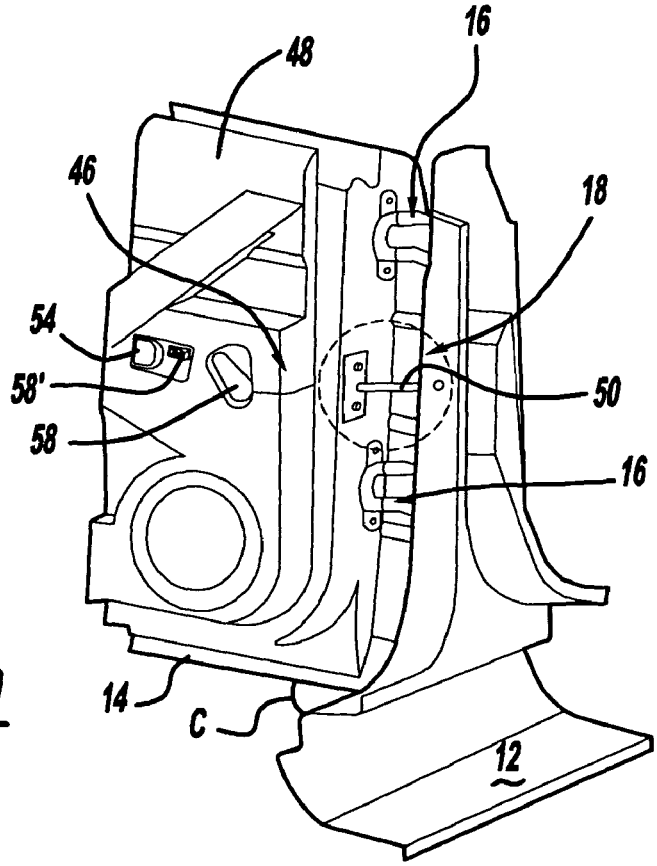
FIG. 2*d* is a detailed perspective view of the vehicle door of FIG. 1 in a third full open position.
Figure 5:
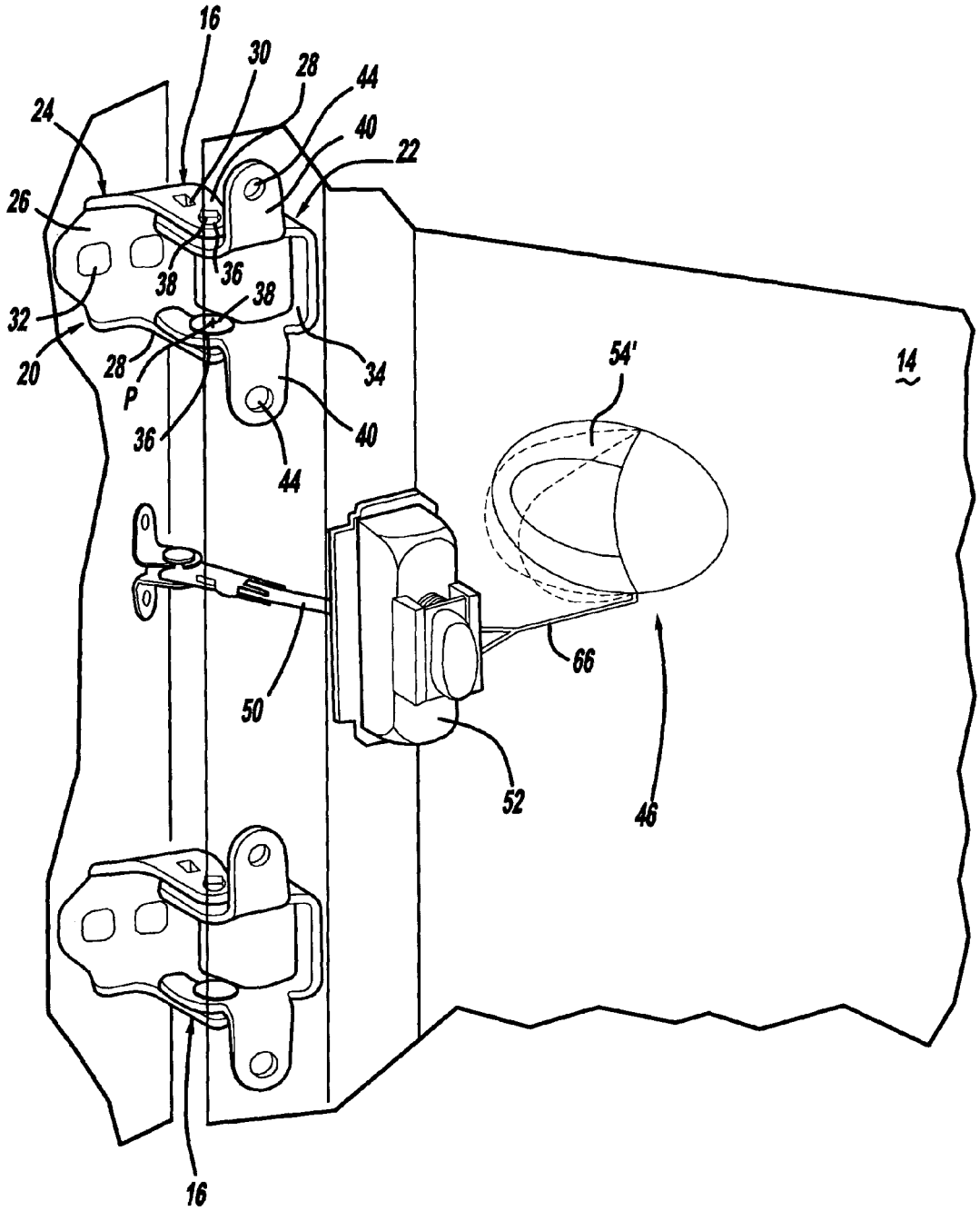
FIG. 5 is a perspective view of an alternative opening mechanism for the vehicle door of FIG. 1.

The door latch 56 may be any mechanism capable of releasably securing the door 14 into a closed position, such as a striker and strike plate assembly (not shown). The switch 58 is coupled to the interior surface 48 of the door 14 and may also be any type of mechanism which is capable of releasing the door 14 into the third full open position, such as, a lever, handle, push button or other device. For illustrative purposes only, FIGS. 2B, 2C and 2D illustrate a first embodiment of the switch 58 as a lever and an alternative embodiment wherein a switch 58' is a push button. It will be further understood, as shown in FIG. 5, that alternatively the switch 58, 58' could be integrated with the first lever 54, such that a first lever 54' may perform the function of both the first lever 54 and the switch 58. With reference back to FIG. 3, the switch 58 is coupled to the housing 52 via a linkage 66. The linkage 66 is configured such that when the switch 58 is actuated the linkage 66 will interact with the housing 52 to enable the door 14 to enter the third full open position, as will be described in greater detail below.

Figure 4:
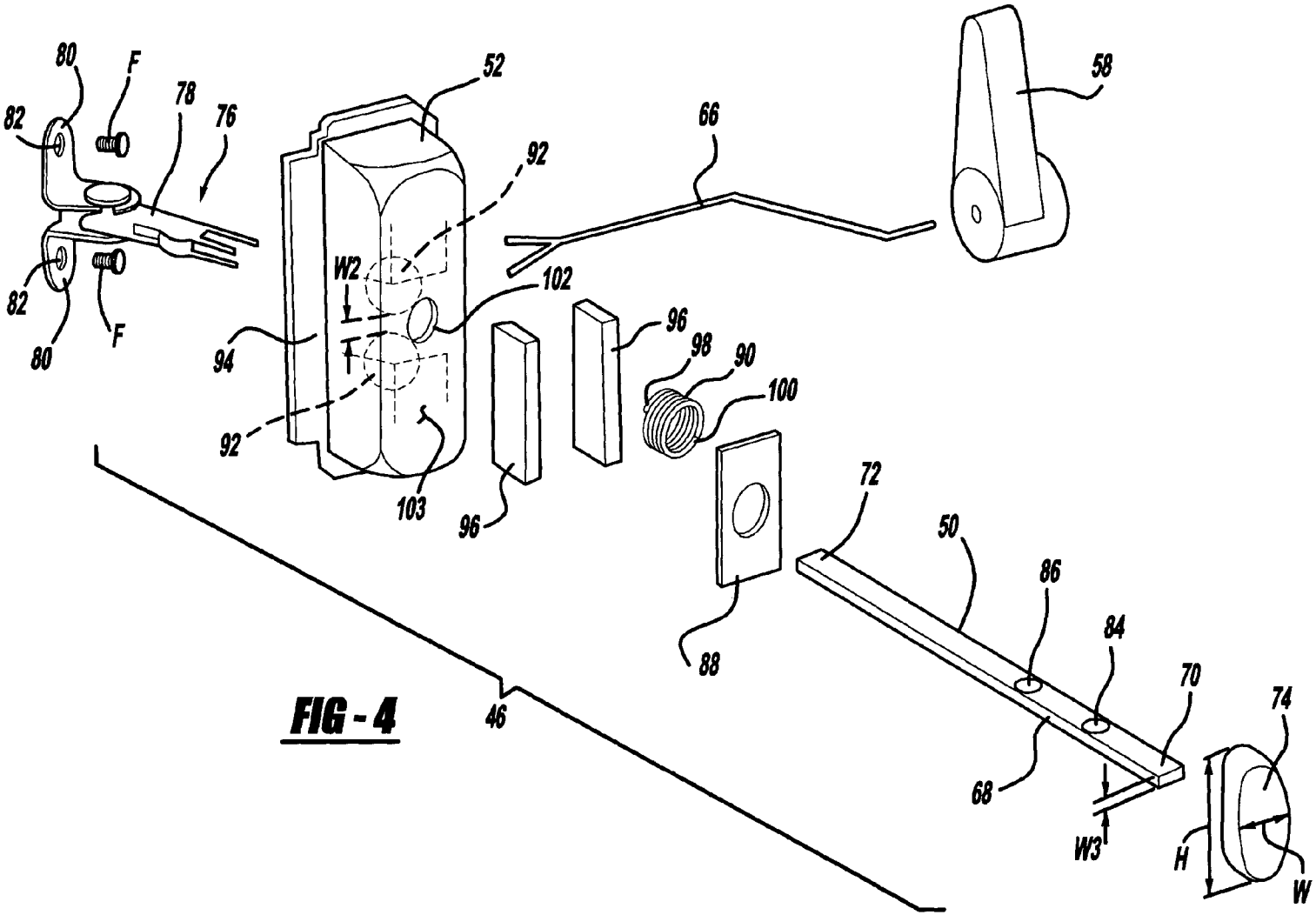
FIG. 4 is an exploded view of the opening mechanism for the vehicle door of FIG. 1.

With reference to FIG. 4, the door check strap 50 enables the door 14 to pivot via the hinges 16 when the opening system 46 releases the door latch 56 via the first lever 54. The door check strap 50 includes a strap body 68 having a first end 70 and a second end 72. The strap body 68 is coupled to the housing 52 in such a manner that the first end 70 and second end 72 are disposed on opposite sides of the housing 52. The first end 70 is coupled to a stop 74. The stop 74 is generally larger than the door check strap 50 and shaped to interact with the housing 52, as will be described in greater detail below. Typically, the stop 74 is shaped to have a height H which is greater than a width W, however, any appropriate shape may be used to interface with the housing 52 and door check strap 50. The stop 74 may be formed of any material suitable to interact with the housing 52, such as rubber or other polymeric materials.

The second end 72 is coupled to a door attachment flange 76. The door attachment flange 76 may be integrally formed with the strap body 68 or more typically may be attached to the second end 72 of the strap body 68 via any suitable fastening mechanism, such as screws, rivets or in the alternative, an interference fit. The door attachment flange 76 includes a generally T-shaped body 78 having branches 80 with at least one aperture 82 formed on each of the branches 80. The at least one aperture 82 is configured for receipt of at least one fastener F to couple the strap body 68 to the passenger compartment 12.

The strap body 68 includes a first protrusion 84 and a second protrusion 86. The first protrusion 84 and second protrusion 86 are generally formed in the strap body 68, but the first protrusion 84 and second protrusion 86 may also be formed in a post processing step, through machining for example. The door check strap 50 may be comprised of formed steel; however, any material with suitable strength could be employed. The first protrusion 84 cooperates with the housing 52 to enable the door 14 to pivot into the second position, while the second protrusion 86 cooperates with the housing 52 to enable the door 14 to pivot into the first position. Thus, the first protrusion 84 and second protrusion 86 are formed on the strap body 68 in such a location that the door 14 is able to pivot into the first and second positions.

The housing 52 is operable with the door check strap 50 to enable the door 14 to pivot into the first, second and third positions, as best shown in FIGS. 2*b*, 2*c* and 2*d*. With reference to FIG. 4, the housing 52 includes a release plate 88, a spring 90 and a pair of bearings 92 retained in a body 94 of the housing 52. The ball bearings 92 are generally disposed adjacent to a biasing member (not specifically shown) to enable the first protrusion 84 and second protrusion 86 to pass through the ball bearings 92. The housing 52 is generally mounted on an inner surface of the door 14 (not specifically shown). The body 94 of the housing 52 further includes a pair of projections 96 for receipt of the spring 90 and release plate 88. More specifically, the spring 90 includes a first end 98 and a second end 100. The first end 98 of the spring 90 is disposed adjacent to a surface 103 of the body 94 and the second end 100 of the spring 90 is coupled to the release plate 88. In addition, the first end 98 of the spring 90 is coupled to the linkage 66 and thus the switch 58. Hence, when the switch 58 is activated, the first end 98 of the spring 90 is pulled towards the second end 100 of the spring 90, thus compressing the spring 90. The first end 98, second end 100 and release plate 88 are enclosed in the projections 96.

The release plate 88 is coupled to the spring 90. The release plate 88 is sized to engage the stop 74 and to be retained in the projections 96. The release plate 88 may be comprised of a polymeric or metallic material. The release plate 88 is operable to be displaced towards the surface 103 of the body 94 when the spring 90 is compressed by the switch 58.

The pair of bearings 92 is enclosed in the body 94 of the housing 52. The bearings 92 are configured to be positioned a width W2 apart, which is slightly greater than a width W3 of the body 94 of the door check strap 50. Thus, the bearings 92 are sized such that the bearings 92 engage the first and second protrusions 84, 86 when the door check strap 50 passes through an aperture 102 defined in the housing 52 as will be described in greater detail below. The bearings 92 may be comprised of steel or other materials with sufficient rigidity.

In order to pivot the door to the first, second and third positions, the occupant (not shown) in the passenger compartment 12 may activate the first lever 54 to release the door latch 56. Once the door latch 56 is released, as shown in FIGS. 1, 2b, 2c and 2d, the weight of the door 14 will cause the door 14 to pivot open on the hinges 16. As the door 14 begins to pivot about the pivot point P, the strap body 68 will begin to pass through the bearings 92 in the body 94 of the housing 52. The door 14 will stop pivoting when the second protrusion 86 of the door check strap 50 engages the bearings 92, stopping the door 14 in a first full open position A. The first position exists generally when the door 14 is displaced approximately forty-five degrees away from the passenger compartment 12, however, the first position may be any pre-selected angle depending upon the particular motor vehicle.

Application of additional force to the door 14 will cause the second protrusion 86 to pass through the bearings 92. As the second protrusion 86 passes through the bearings 92, the strap body 68 continues to pass through the bearings 92 allowing the door 14 to pivot further on the hinges 16 until the first protrusion 84 of the door check strap 52 contacts the bearings 92. When the first protrusion 84 contacts the bearings 92, the door 14 is held in a second full open position B. When the door 14 is the in the second full open position B., the door 14 is pivoted approximately seventy degrees away from the passenger compartment 12, however, the second position may be varied depending upon the particular motor vehicle 10. Also, when the door 14 is in the second position, the stop 74 is adjacent to the release plate 88 of the housing 52.

Figure 3:
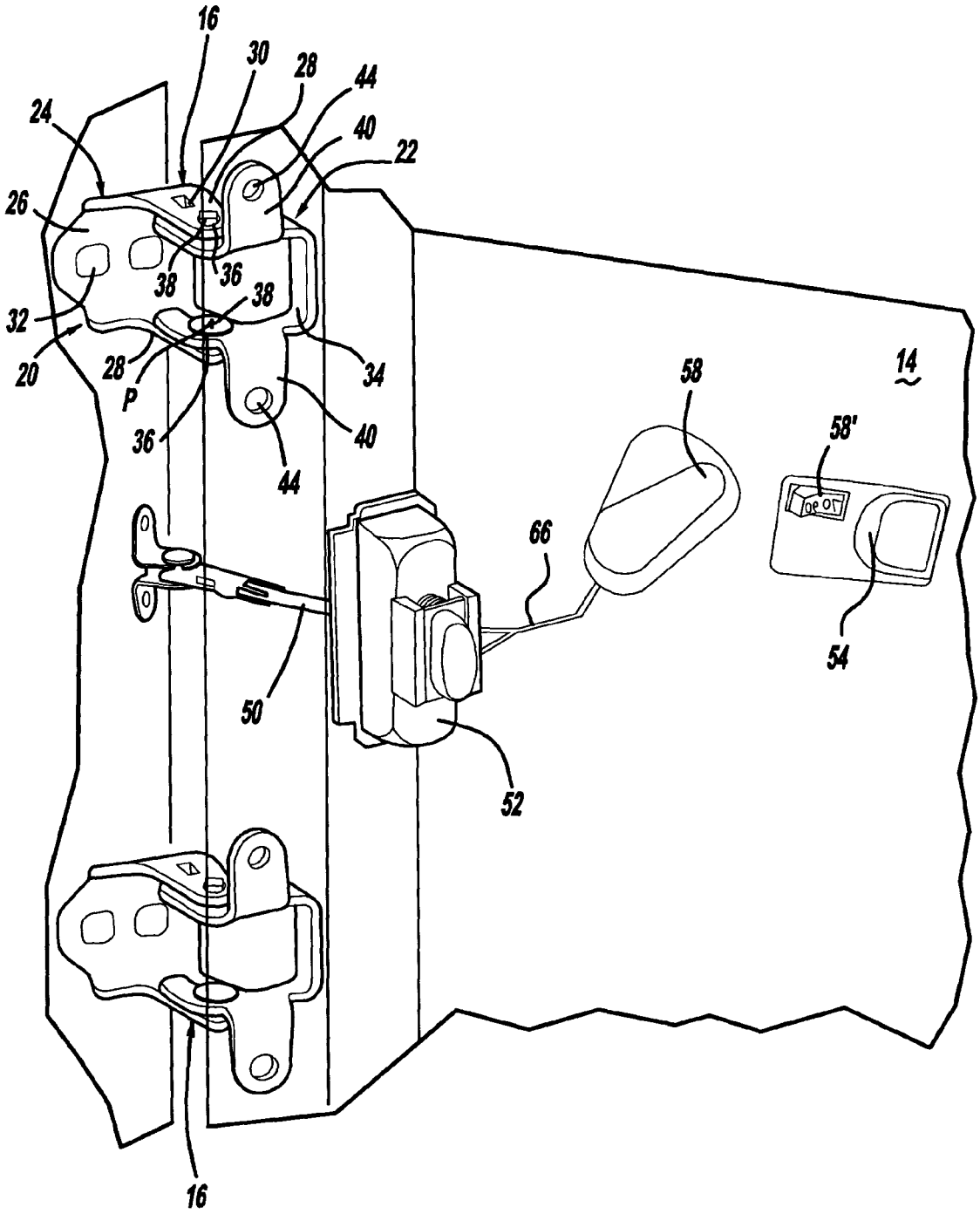
FIG. 3 is a perspective view of the vehicle door with selective full open positions.

In order to release the door 14 into the third position, the occupant in the passenger compartment 12 may activate the switch 58. By activating the switch 58, the linkage 66 operates to compress the spring 90, by pulling the first end 98 of the spring 90 towards the second end 100 of the spring 90. As the spring 90 compresses, the release plate 88 is pulled further into the projections 96 and when the spring 90 is fully compressed, the release plate 88 is recessed to the point that the stop 74 is fully housed between the projections 96. By enabling the stop 74 to enter between projections 96 of the housing 52, the strap body 68 of the door check strap 50 can move further through the bearings 92 to allow the door 14 to pivot into a third full open position C, as best shown in FIGS. 1 and 2*d*. With reference to FIG. 3, the lanced depressions 30 on the hinges 16 and the size of the spring 90 operate to stop the door 14 once it reaches the third position. In this embodiment, the door 14 is in the third position when it is rotated approximately ninety degrees from the passenger compartment 12, however, the third position could be any desired angle for the particular application as could the other two as determined by the placement of the lanced depressions 30 and the compressibility of the spring 90.

When the occupant in the passenger compartment 12 desires to close the door 14, the force used by the occupant to close the door 14 will cause the door check strap 50 to pass though the bearings 92, and depending on the force employed, the first protrusion 84 and second protrusion 86 may pass through the bearings 92 as well. As the door check strap 50 passes through the bearings 92, the stop 74 is displaced from the release plate 88 and the spring 90 is able to expand, allowing the release plate 88 to reset to its original position. Thus, the occupant, if desired, may return the door 14 into the first or second position without closing it.

The door 14 of the present invention provides an occupant in the passenger compartment 12 with improved egress and ingress to and from the passenger compartment 12 by having variable full open positions. The door 14 also makes it easier for occupants to load items into the passenger compartment 12 by allowing the door 14 to be opened at approximately ninety degrees from the passenger compartment 12. In addition, the switch 58 can be spaced apart from the first lever 54 in such a manner that it can prevent children from mistakenly opening the door 14 into the third position.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for establishing at least two open access door positions relative to an opening of a compartment, the apparatus comprising:

a position defining member having a stop member, said position defining member coupled to the compartment, and including a door check strap slideably coupled to a housing member to enable the access door to pivot into a first open position, a second open position and further into a third open position relative to the compartment, the door check strap having a first end coupled to the stop member and a second end adapted to be coupled to the compartment;

the housing member adapted to be coupled to the access door for movement therewith, the housing member including:

an opening therethrough for translatable receipt of the door check strap;

an engagement element positioned within the housing member that engages the door check strap to establish the first open position and the second open position;

a pair of projections coupled to and extending from an exterior surface of the housing, the projections having a longitudinal axis perpendicular to a longitudinal axis of the door check strap;

at least one spring positioned between the projections and having a first end coupled to the exterior surface of the housing member, the spring having a longitudinal axis parallel to the longitudinal axis of the door check strap;

a release plate positioned between the projections and coupled to a second end of the spring, the release plate operable to engage the stop member of the door check strap in a first position and a second position, the door check strap configured to translate through an opening in the release plate and the opening in the housing member; and a lever coupled to the access door and the housing member, the lever operable to be activated to compress the spring to retract the release plate towards the housing member into the second position to enable the stop member to engage the release plate in the second position and enable the access door to further pivot beyond the first and second open positions into the third open position, the stop member being positioned between the projections when engaging the release plate in the second position, wherein in the first position of the release plate, the spring is uncompressed; and wherein the stop member contacting the release plate in the second position establishes the third open position approximately perpendicular to the compartment, and the door check strap includes a first protrusion and a second protrusion that each cooperate with the engagement element of the housing member to establish the first open position and the second open position.

2. The apparatus of claim 1, wherein the access door is in the first open position at a rotation of approximately forty-five degrees with respect to the compartment.

3. The apparatus of claim 1, wherein the access door is in the second open position at rotation of approximately seventy degrees with respect to the compartment.

4. The apparatus of claim 1, wherein the engagement element of the housing member comprises a plurality of bearings located adjacent to the opening of the housing member, the plurality of bearings operable to engage the first and second protrusions on the door check strap.

5. The apparatus of claim 1, further comprising at least one hinge including at least one feature to prevent the access door from pivoting in the third open position beyond approximately ninety degrees.

6. An apparatus for providing access into a passenger compartment of a motor vehicle comprising:

a door operable to provide access into the passenger compartment;

at least one hinge operable to pivotably couple the door to the motor vehicle;

a door release mechanism operable to enable the door to pivot on the at least one hinge, the door release mechanism coupled to the passenger compartment and the door, the door release mechanism including:

a lever coupled to the door;

a compressible surface coupled to the lever, the compressible surface operable in a first position and a second position;

a housing that couples the door release mechanism to the door;

a door check strap slideably coupled to the housing and the compressible surface to enable the door to pivot into a first open position, a second open position and further into a third open position perpendicular to the passenger compartment;

wherein the compressible surface includes:

at least one spring disposed between a pair of spaced apart projections extending from an outer surface of the housing and coupled to the lever, the projections having a longitudinal axis perpendicular to a longitudinal axis of the door check strap;

a release plate coupled to the spring and operable to engage a stop of the door check strap, the release plate positioned between the projections; and wherein activation of the lever compresses the spring, retracting the release plate relative to the projections and towards the housing to create the second position of the compressible surface, and wherein the stop of the door check strap is operable to enter a recess between the projections created by the retraction of the release plate and engage the compressible surface in the second position to enable the door to further pivot into the third position perpendicular to the passenger compartment, the door check strap configured to extend through an opening in the release plate and an opening in the housing.

7. The apparatus of claim 6, wherein the door is in the first position at a rotation of approximately forty-five degrees with respect to the passenger compartment.

8. The apparatus of claim 6, wherein the door is in the second position at rotation of approximately seventy degrees with respect to the passenger compartment.

9. The apparatus of claim 6, wherein the door release mechanism further comprises a plurality of bearings located within the housing, the plurality of bearings operable to engage the door check strap to enable the door to enter the first and second positions.

10. The apparatus of claim 9, wherein the door check strap further comprises:

a coupler at a first end, the coupler operable to couple the door check strap to the passenger compartment of the motor vehicle;

at least one protrusion operable to engage the plurality of bearings in the door release mechanism to retain the door in the first and second positions;

wherein the stop is operable to engage the compressible surface in the first position and the second position; and wherein the stop engages the compressible surface in the first position to enable the door to pivot into the second position, and the stop engages the compressible surface in the second position to enable the door to pivot into the third position.

11. The apparatus of claim 6, wherein the at least one hinge includes at least one feature to prevent the door from pivoting in the third position beyond approximately ninety degrees.

* * * * *